United States Patent [19]

Fehr et al.

[11] Patent Number: 4,624,702

[45] Date of Patent: Nov. 25, 1986

[54] METHOD OF VAPORIZING ADDITIVES IN METAL MELTS

[75] Inventors: Kurt Fehr; Ivo Henych; Rudolf Pavlovsky, all of Schaffhausen, Switzerland

[73] Assignee: Georg Fischer Aktiengesellschaft, Schaffhausen, Switzerland

[21] Appl. No.: 796,097

[22] Filed: Nov. 7, 1985

[30] Foreign Application Priority Data

Dec. 21, 1984 [CH] Switzerland ..... 6124/84

[51] Int. Cl.[4] ..... C22B 9/00

[52] U.S. Cl. ..... 75/93 R; 75/53; 75/58

[58] Field of Search ..... 75/93 R, 53, 130 R, 75/130 C, 58, 130 A; 420/590; 266/216

[56] References Cited

U.S. PATENT DOCUMENTS 3,666,449 5/1972 Alt ..... 75/130

*Primary Examiner*—Peter D. Rosenberg

*Attorney, Agent, or Firm*—Toren, McGeady, Stanger, Goldberg & Kiel

[57] ABSTRACT

A method of vaporizing additives in a metal melt. The method is carried out in a vessel which has a chamber in which at least one additive is placed. The geometric configuration of the chamber and the total cross-sectional area of the openings are adjusted in relation to the amount T of metal melt, so that a vaporization $t=68\times T^{0.22}\times A$ is obtained. This method has the advantage that parameters, such as, residual magnesium content can be accurately reproduced.

4 Claims, 2 Drawing Figures

METHOD OF VAPORIZING ADDITIVES IN METAL MELTS

BACKGROUND OF THE INVENTION

The present invention relates to a method of vaporizing additives in metal melts.

Additives are vaporized under atmospheric pressure in a metal melt by means of known equipment which includes a vessel having a chamber into which the additives can be introduced from the outside and in which the additives are vaporized under the influence of the metal melt which flows from the vessel into the chamber through appropriately arranged openings.

The prerequisite for this vaporization is the characteristic of the additives, such as, lithium, calcium, magnesium, etc. to develop at the temperature of the metal melt a vapor pressure which exceeds the metallostatic pressure of the metal melt prevailing within the chamber.

The vaporized additives escape from the chamber into the metal melt through some of the openings mentioned above. If the geometric configuration of the openings, the total cross-sectional area of the openings and the chamber volume do not have the proper relationship to the level of the bath of metal melt, or the volume of the vessel, or the content of certain elements obtained in the metal melt, such as, sulphur, hydrogen or oxygen, it is not possible to obtain an optimum vaporization with a high degree of efficiency and a reproducible residual content of the additives or the elements in the metal melt. All of these influences result in a certain time required for the vaporization of the additives.

Very long or very short vaporization time cause a decrease of the efficiency of the additives and of the accuracy in obtaining a predetermined residual content of the additives or of the elements in the metal melt. When the vaporization time is too long or the size of the openings in the chamber is too small, these openings may be clogged due to solidification of the metal melt or of the reaction products. A vaporization time which is too short results in a vehement reaction with substantial slopping of metal melt. In both these cases, additional technical problems occur with respect to safety of operation.

It is, therefore, the primary object of the invention to obtain an accurate reproducibility of the parameters of the end product, for example, the residual magnesium content, the degree of the deoxidation, etc. and to improve the efficiency of the additives.

SUMMARY OF THE INVENTION

In accordance with the present invention, the method of vaporizing additives in a metal melt includes the steps of introducing the metal melt in a vessel and at least one additive into a chamber formed by a wall in the vessel, conducting the metal melt through openings defined in the wall into the chamber, and vaporizing the additive in the chamber and permitting the vaporized additive to flow through the openings into the metal melt in the vessel. The relation of the geometric configuration and size of the chamber and the size of the total cross-sectional area of the openings to the amount T of metal melt in tons and the element contained in the metal melt to be bound by the additive results in a vaporization t in seconds which is adjusted in accordance with the formula $t=68\times T^{0.22}\times A$ wherein A is a coefficient selected in accordance with the additive to be vaporized.

If magnesium is to be vaporized as an additive in the metal melt, the coefficient A is adjusted in the range of from 0.5 to 1.5.

If calcium is to be vaporized as an additive in the metal melt, the coefficient A is adjusted in the range of from 0.7 to 1.2.

If lithium is to be vaporized as an additive in the metal melt, the coefficient A is adjusted in the range of from 0.4 to 1.1.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
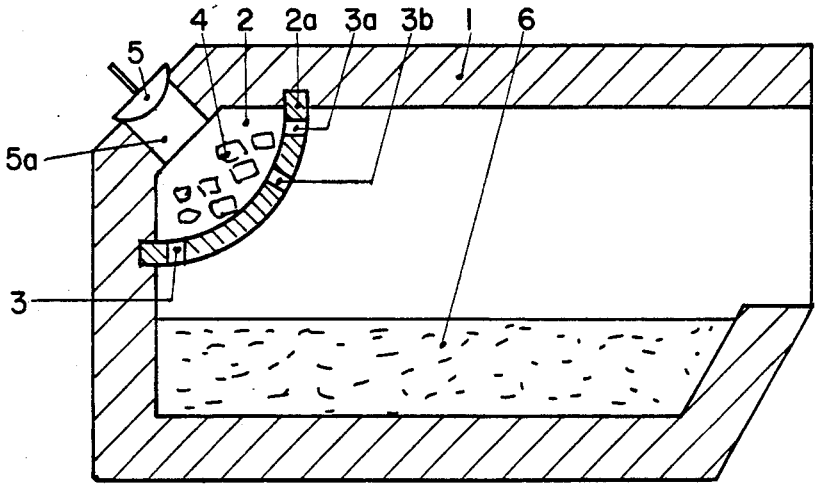
FIG. 1 is a sectional view of a vessel for carrying out the method according to the invention, illustrated in the filling position.
Figure 2:
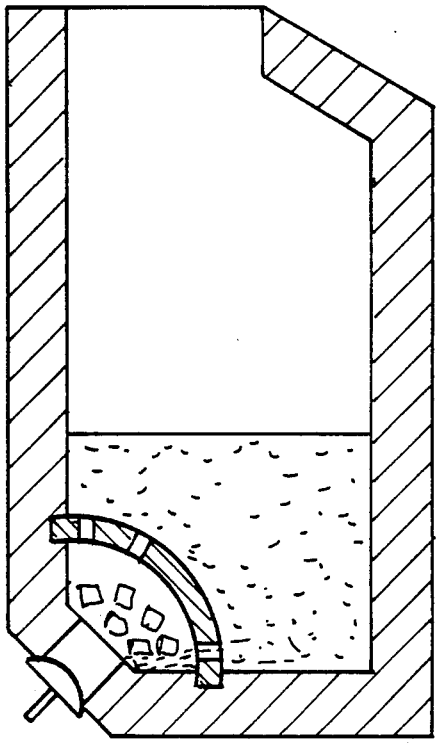
FIG. 2 is a sectional view of the vessel shown in FIG. 1, illustrated in the treatment position.

As illustrated in FIG. 1 of the drawing, a vessel 1 has a chamber 2 formed by a wall 2*a*. The additives 4 to be vaporized are added to chamber 2 through an opening 5*a* which can be closed by means of a closure 5. Wall 2*a* of chamber 2 has openings 3, 3*a* and 3*b*. These openings serve different functions. The metal melt 6 flows through opening 3 into chamber 2, while the vaporized additives 4 flow out of the chamber 2 through openings 3*a* and 3*b*. Vessel 1 is swung in the known manner from the filling position illustrated in FIG. 1 to the vertical position illustrated in FIG. 2, so that the process of vaporizing the additives is started. In other words, vaporization of the additives commences at the moment the metal melt 6 enters chamber 2 through opening 3.

The method in accordance with the present invention shall be explained in more detail with the aid of the following examples.

EXAMPLE 1

Five tons of metal melt were filled into vessel 1. 12 kg of magnesium as an additive were previously placed in chamber 2. The reaction commenced at the moment when vessel 1 had reached its vertical position. The reaction was concluded after 97 seconds. The reaction caused the initial sulphur content to be reduced from 0.09% to 0.006% and a residual magnesium content of 0.05% in the metal melt was obtained.

In a test series consisting of several reactions conducted in accordance with the formula $t=68\times T^{0.22}\times A$, a maximum variation of the residual magnesium content of ±0.005% was found. Coefficient A was 1.

EXAMPLE 2

One ton metal melt was filled into vessel 1. 1.5 kg magnesium as an additive were previously placed in chamber 2. The reaction commenced at the moment when vessel 1 had reached its vertical position. The reaction was concluded after 52 seconds. The reaction caused the initial sulphur content to be reduced from 0.03% to 0.006% and a residual magnesium content of 0.045% in the metal melt was obtained.

In a test series consisting of several reactions conducted in accordance with the formula $t=68\times T^{0.22}\times A$, a maximum variation of the residual magnesium content of ±0.005% was found. Coefficient A was 0.76.

In preliminary tests in which the vaporization times were adjusted in accordance with coefficient A either below 0.5 or above 1.5, a greater variation of the residual magnesium content and a poorer efficiency of the additive were found.

The range of coefficient A for magnesium of between 0.5 to 1.5% corresponds to the range of the sulphur content of 0.01 to 0.15%.

Other possible additives are, for example, lithium and calcium.

EXAMPLE 3

One ton metal melt was filled into vessel 1. 0.25 kg of lithium as the additive were previously placed in chamber 2. The reaction commenced at the moment when vessel 1 had reached its vertical position. The reaction was concluded after 39 seconds. The reaction caused the initial hydrogen content to be lowered from 5.2 ppm to 1.1 ppm and the oxygen content was lowered from 7.67 ppm to 5 ppm.

In a test series consisting of several reactions conducted with the reaction time adjusted in accordance with the formula $t=68\times T^{0.22}\times A$, a variation of the hydrogen and oxygen contents of ±0.3 ppm were found. Coefficient A was 0.57.

In preliminary tests conducted with vaporization times adjusted in accordance with coefficient A either below 0.4 or above 1.1, a greater variation of the final hydrogen and oxygen contents and a poorer efficiency of the additive were found.

While specific embodiments of the invention have been shown and described in detail to illustrate the application of the inventive principles, it will be understood that the invention may be embodied otherwise without departing from such principles.

We claim:

1. A method of vaporizing additives in a metal melt, comprising introducing the metal melt containing an element to be bound by the additive into a vessel and introducing at least one additive into a chamber formed by a wall in the vessel, conducting the metal melt through openings defined in the wall into the chamber into contact with the addition and thereby commencing the reaction by vaporizing the additive in the chamber and permitting the vaporized additive to flow through the chamber openings into the metal melt in the vessel, maintaining the relation of the geometric configuration and size of the chamber and the size of the total cross-sectional area of the openings to the amount T of metal melt in tons and to the element contained in the metal melt to be bound by the additive so that a vaporization time t in seconds results, and adjusting the vaporizatin time in accordance with the formula $$t=68\times T^{0.22}\times A,$$

wherein A is a coefficient selected in accordance with the additive to be vaporized.

2. The method set forth in claim 1, wherein the additive is magnesium, comprising adjusting coefficient A in the range of from 0.5 to 1.5.

3. The method set forth in claim 1, wherein the additive is calcium, comprising adjusting coefficient A in the range of from 0.7 to 1.2.

4. The method set forth in claim 1, wherein the additive is lithium, comprising adjusting coefficient A in the range of from 0.4 to 1.1.

* * * * *